US005280974A

United States Patent [19]

Weintroub

[11] Patent Number: 5,280,974

[45] Date of Patent: * Jan. 25, 1994

[54] SAFETY DRAW-LATCH

[76] Inventor: Etienne L. Weintroub, 111-17a Zahal Str, Givat Amos Nesher, Israel

[ * ] Notice: The portion of the term of this patent subsequent to Jun. 25, 2008 has been disclaimed.

[21] Appl. No.: 16,645

[22] Filed: Feb. 19, 1987

[30] Foreign Application Priority Data

Nov. 3, 1986 [IL] Israel ..... 78113

[51] Int. Cl.[5] ..... E05C 1/12

[52] U.S. Cl. ..... 292/164; 292/336.3; 292/DIG. 65; 292/DIG. 27

[58] Field of Search ..... 292/172, 332, 164, 336.3, 292/169 R, DIG. 65, DIG. 27, DIG. 38; 70/207, 223

[56] References Cited

U.S. PATENT DOCUMENTS

| | | | |
|---|---|---|---|
| 129,527 | 7/1872 | Calhoun et al. | 292/169 X |
| 1,460,614 | 7/1923 | Smith, Jr. | 292/164 |
| 1,576,612 | 3/1926 | Keeler | 292/332 |
| 1,909,361 | 5/1933 | Kaimer | 292/164 |
| 1,968,285 | 7/1934 | Egan | 292/172 |
| 1,991,822 | 2/1935 | Snipes | 70/207 X |

*Primary Examiner*—Richard E. Moore

[57] ABSTRACT

A safety draw-latch which can be opened by normal adults but not by people with less coordination such as children or mental defectives. It differs from normal latches in that a complex set of actions must be carried out in one continous movement.

3 Claims, 3 Drawing Sheets

SAFETY DRAW-LATCH

BACKGROUND OF THE INVENTION

1. Field of the Invention

An improvement on the common draw latch which, while allowing normal adults to open or close it at will, inhibits its use by people not possesing the degree of coordination normal to adults, i.e. children or mental defectives.

2. Description of the Prior Art

A drawlatch is a device which enables any person to open or close the opening locked by it without the use of a key. If a person can reach it he can open it. In a number of cases, e.g. medicine cabinets or kitchen cupboards, there is however a need for a latch which will not allow access to certain people. The alternative to a latch is a lock, which requires a key. The key itself tends to be mislaid and sometimes to get into the wrong hands. The act of locking and unlocking the lock and inserting and removing the key is often inconvenient.

SUMMARY OF THE INVENTION

Opening the latch is made difficult for undesirable persons by complicating the operation of the latch. To open the latch it is necessary to move a knob in two linear directions and then rotate the knob in a given direction, all in one continuous movement.

In the accompanying drawings I have illustrated several embodiments of my invention FIG. 1 is a side view of the latch. Refered to as model 1.

List and brief description of parts.

| Part No. | Description |
|---|---|
| 1 | External Knob |
| 2 | Connecting Rod |
| 3 | Friction Wheel |
| 4 | Spring |
| 5 | Base Plate |
| 6 | Slide |
| 7 | Slide Retainers |
| 8 | Slot in Base Plate and also in device to be locked |
| 9 | Spring |
| 10 | Slot in Slide |
| 11 | Device to be locked, to which the Draw-latch is attached |
| 12 | Recess or Catch in the device to be locked |
| 13 | Portion of slide with which the internal wheel engages |
| 14 | Device to keep the slide in an open position until the door or drawer closes. |

Note:
The arrows "X", "Y"and "Z" denote direction of movement

DESCRIPTION OF THREE PREFERRED EMBODIMENTS

Prior to mounting the draw-latch a slot is made in the device to be locked (11) complementary to the slot (8) in the base plate (5). The base plate (5) is attached to the device to be locked (11) by glue, screws or studs.

Description of model 1: (Refer to drawings)

Figure 1:
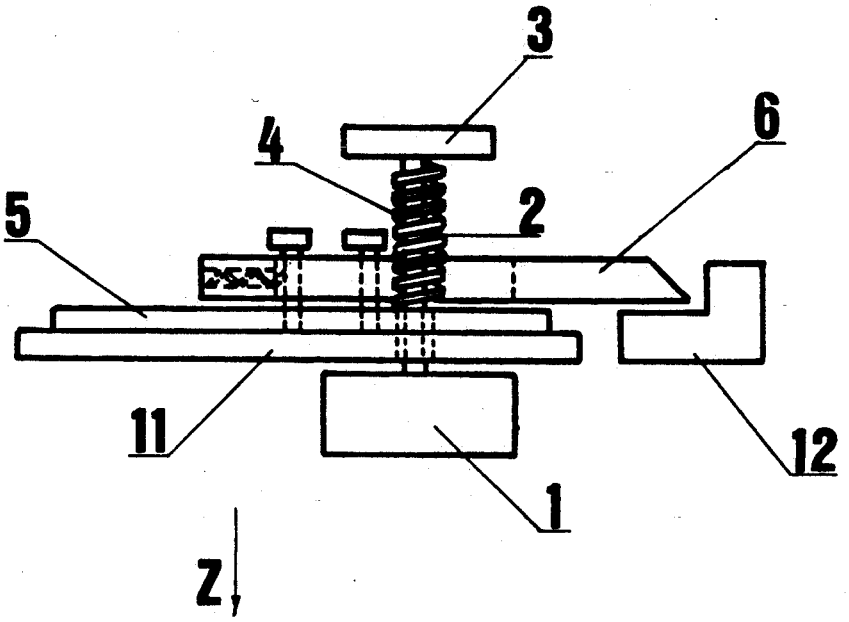
Figure 2:
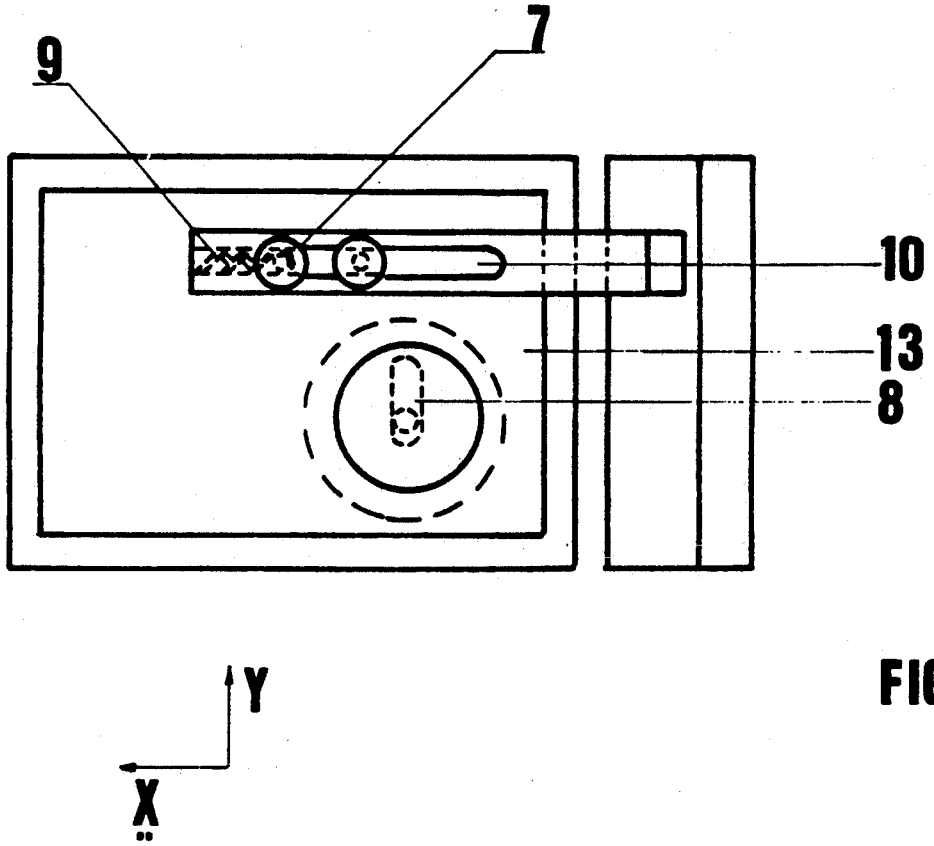
FIG. 2 is a plan view thereof.
Figure 3:
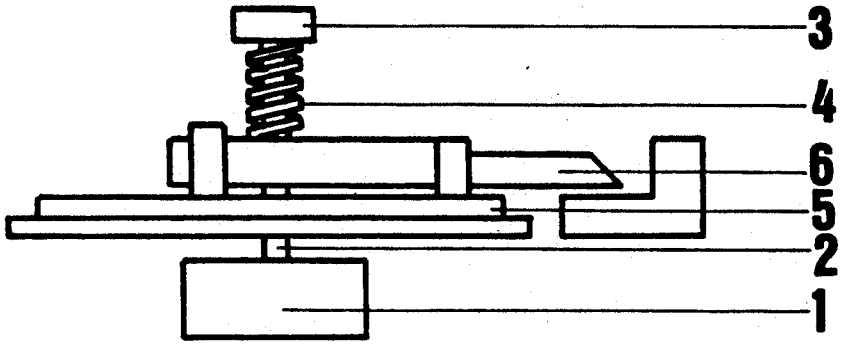
FIG. 3 is a side view of a modified form of the latch. Refered to as model 2.
Figure 4:
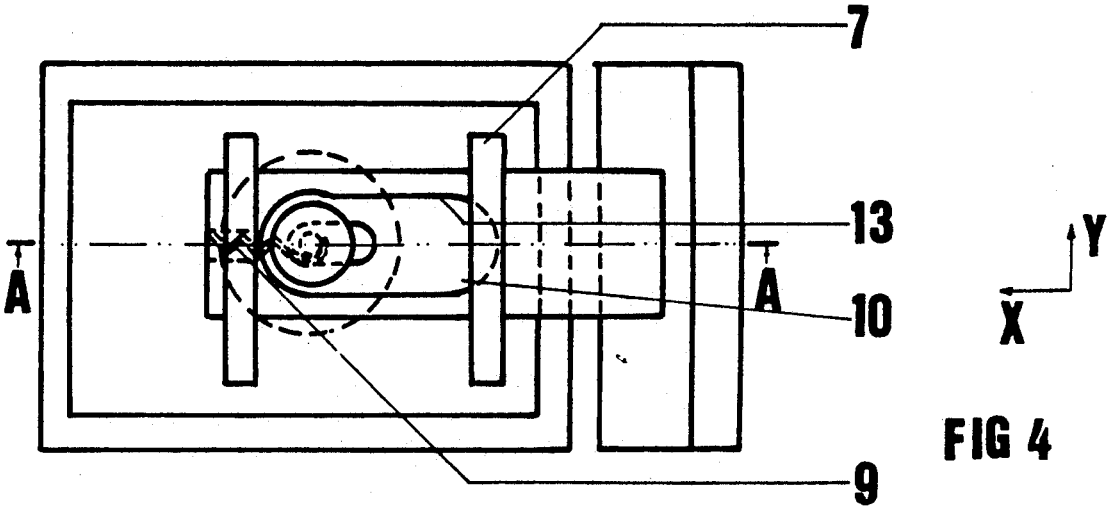
FIG. 4 is a plan view thereof.
Figure 5:
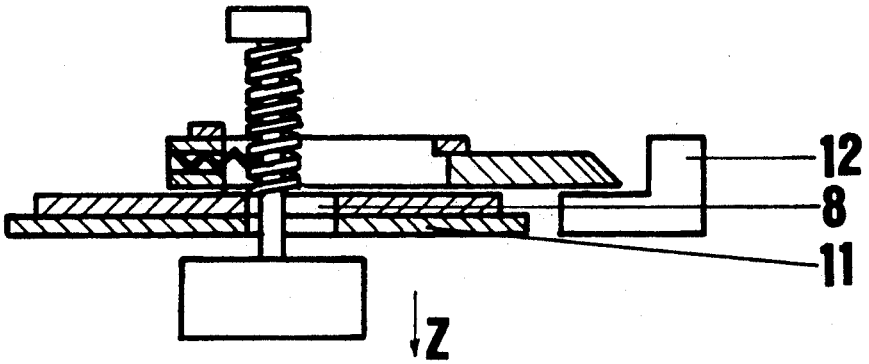
FIG. 5 is a sectional view on the line A—A of FIG. 4.
Figure 6:
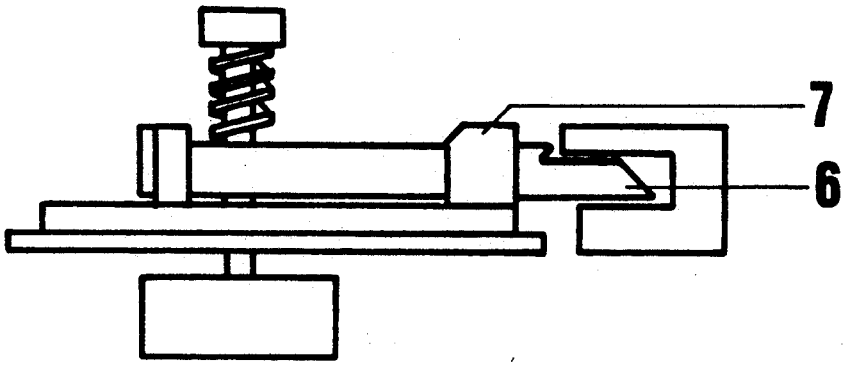
FIG. 6 is a side view of a futher modification of the latch. Refered to as model 3.
Figure 7:
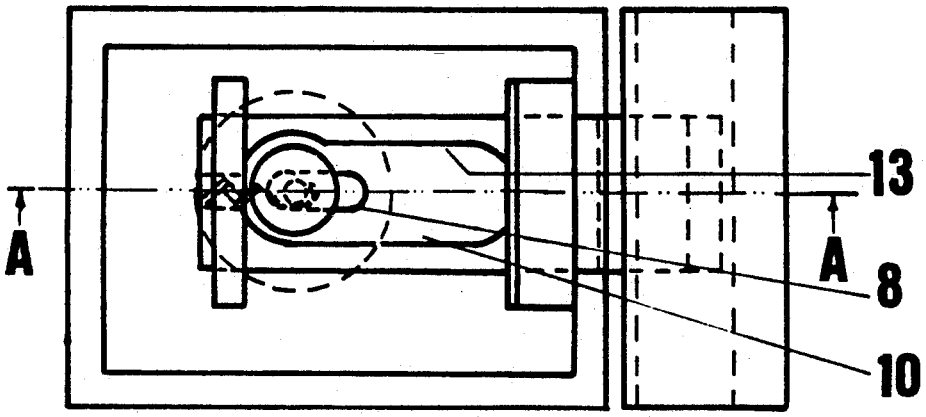
FIG. 7 is a plan view thereof.
Figure 8:
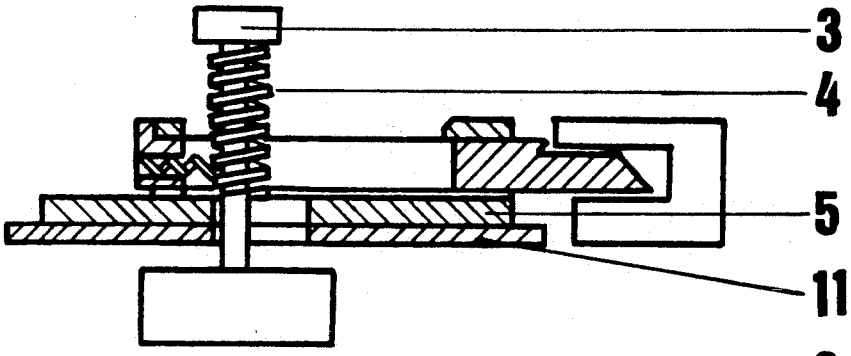
FIG. 8 is a sectional view on the line A—A of FIG. 7.
Figure 9:
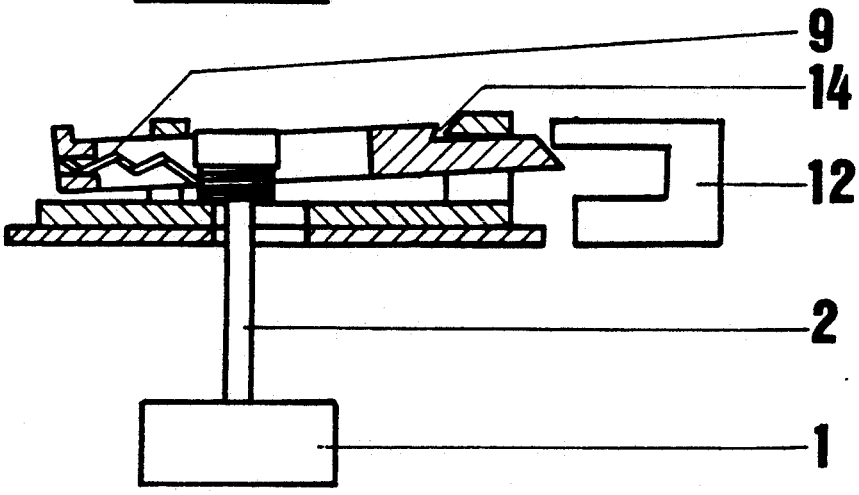
FIG. 9 is a sectional view on the line A—A of FIG. 7 of the latch in the open position before releasing the external knob.

The external knob (1), which is on the outside of the device to be locked is attached to the drive shaft (2) which in turn is attached to the friction wheel (3). The drive shaft passes through a slot (8) in the base plate (5) and the device to be locked (11). The drive shaft (2) provides a rigid connection between the external knob (1) and the friction wheel (3). The spring (4) keeps the external knob-drive shaft-friction wheel assembly in its normal position (see FIG. 1). The slide (6) is held against the base plate by two slide retainers (7) which enable the slide to move only in the plane of arrow "X". The spring (9) normally keeps the slide (6) in the locked in the locked position. When the slide (6) is in the locked position it protrudes over the end of the base plate (5) and engages the recess or catch (12) on the opposing part of the device to be locked (11). In the locked position the portion of the slide with which the friction wheel engages (13) is not at the same level as the friction wheel and therefor is not engaged. See FIG. 2

The latch is opened by pulling the external knob (1) in the direction of arrow "Z" against the tension of the spring (4) until the friction wheel (3) is level with the slide (6). The external knob (1) is then moved in the direction "Y" until the friction wheel (3) presses against the portion of the slide with which it engages (13). The external knob (1) is then rotated in the correct direction, turning with it the friction wheel (3) which in turn moves the slide in the direction "X" until the recess or catch (12) is disengaged.

Description of model 2: Refer to drawings.

Model 2 uses the same parts as model 1, but the layout is different. The portion of the slide with which the friction wheel engages (13) lies inside the slot in the slide (10).

The directions for use are identical to those for model 1, except that after the external knob (1) has been moved in the direction "Y" it has to be moved in the direction opposite to that of arrow "X" in order to press the friction wheel (3) against the portion of the slide with which it engages (13).

Description of model 3: Refer to drawings.

Model 3 is identical to model 2 except that the slide (6) has been modified by the addition of a step (14). When the external knob (1) is released after the latch has been opened the spring (4) pushes the friction wheel in the opposite direction to arrow "Z" and with it the slide (6). The step (14) then engages with the foremost slide retainer (7) and thereby locks the latch in the open position with the slide (6) protruding slightly beyond the edge of the foremost slide retainer (7). When the device to be locked (11) is closed the protruding part of the slide (6) is pressed in directions "Z" and "X" by the solid part of the recess or catch (12); The step (14) disengages from the slide retainer (7) ad the spring (9) closes the latch.

I claim:

1. A drawlatch comprised of a slotted base plate, slide retainers, a spring-loaded slide, a friction wheel, a connecting rod, an external knob, and a spring assembled in such a way that the external knob is attached to a connecting rod which passes through an aperture in the base plate, passes through a spring, and is then attached to the friction wheel which can be brought to bear against the correct portion of a spring-loaded slide which is held in position on the base plate by slide retainers which allow the slide to move relative to the base plate, said slide being the latch which engages the catch and which when at rest is held in locked position by its spring, the device being unlocked by grasping the external knob and performing in a single continuous movement the action of pulling, and/or pushing, and/or rotating the external knob/friction wheel assembly, against a predermined force, in a predermined sequence of actions thus bringing the friction wheel to a position where it makes contact with and retracts the slide and releases the catch, the said continuous motion being mandatory because the slide is immediately returned to the closed position by its spring if the friction between the friction wheel and slide is released, the knob/friction wheel assembly being returned to its original position by its own spring should the knob be released.

2. A safety draw-latch as claimed in claim 1 in which the slide once the device to which it has been attached is opened is locked in the open position by a simple mechanical method that leaves the end of the slide slightly protruding, until such time that the device to which it is attached is closed at which point the protruding part of the slide makes contact with the corresponding part in the opposing segment resulting in a force that will release the slide and lockm the device to which it is attached without needing the further intervention of a person.

3. A safety draw-latch as claimed in claim 1 in which the friction wheel and/or the portion of the slide with which it engages are treated in such a way as to enhance friction, such as for example by the addition of gear teeth.

* * * * *